US008567292B1

(12) United States Patent
Park et al.

(10) Patent No.: US 8,567,292 B1
(45) Date of Patent: Oct. 29, 2013

(54) SCREW REMOVAL TOOL

(75) Inventors: Bruce J. Park, Camarillo, CA (US); Michael A. Torres, Newbury Park, CA (US); Mark A. Doty, Port Hueneme, CA (US)

(73) Assignee: The United States of America as Represented by the Secretary of the Navy, Washington, DC (US)

( * ) Notice: Subject to any disclaimer, the term of this patent is extended or adjusted under 35 U.S.C. 154(b) by 352 days.

(21) Appl. No.: 12/732,447

(22) Filed: Mar. 26, 2010

(51) Int. Cl.

| | |
|---|---|
| ***B67B 7/16*** | (2006.01) |
| ***B67B 7/00*** | (2006.01) |
| ***B25B 13/16*** | (2006.01) |
| ***B25B 13/00*** | (2006.01) |
| ***B25B 21/00*** | (2006.01) |
| ***B25B 23/00*** | (2006.01) |
| ***B25B 1/24*** | (2006.01) |
| ***B25B 5/16*** | (2006.01) |
| ***B25B 1/02*** | (2006.01) |
| ***B25B 5/02*** | (2006.01) |
| ***B25B 5/00*** | (2006.01) |

(52) U.S. Cl.
USPC ..... 81/462; 81/3.55; 81/173; 81/3.48; 81/3.33; 81/3.45; 81/3.57; 81/436; 81/52; 269/258; 269/214; 269/249

(58) Field of Classification Search
USPC ..... 81/3.55, 173, 254, 3.33, 3.45, 3.48, 81/3.57, 436, 52, 180, 57.3, 462; 7/165; 269/258, 214
See application file for complete search history.

(56) References Cited

U.S. PATENT DOCUMENTS 1,829,557 A * 10/1931 Ewing ..... 81/462
2,440,820 A * 5/1948 Frank ..... 269/154

* cited by examiner

*Primary Examiner* — Monica Carter
*Assistant Examiner* — Danny Hong
(74) *Attorney, Agent, or Firm* — Christopher L. Blackburn

(57) ABSTRACT

A tool for loosening and/or unscrewing a screw in an object. The tool includes a frame dimensioned and configured to receive (or be mounted on) an object having at least one screw removably embedded therein.

2 Claims, 3 Drawing Sheets

SCREW REMOVAL TOOL

STATEMENT REGARDING FEDERALLY SPONSORED RESEARCH OR DEVELOPMENT

The invention described herein may be manufactured and used by or for the government of the United States of America for governmental purposes without the payment of any royalties thereon or therefor.

FIELD OF THE INVENTION

The invention generally relates to a tool for loosening and/or removing a screw.

Figure 1:
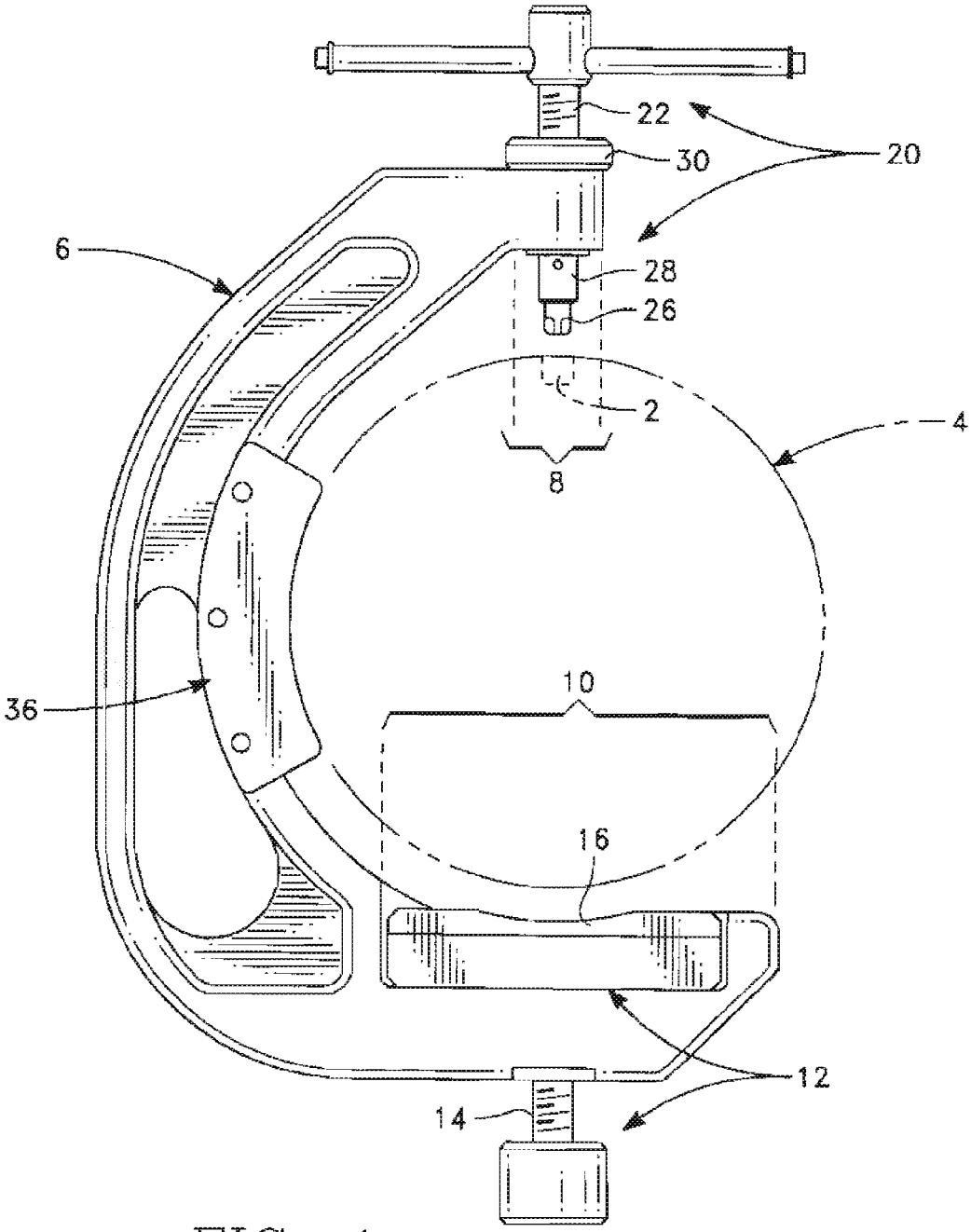
FIG. 1 is a side view of an embodiment of the invention around an object having a screw embedded therein.

It is to be understood that the foregoing and the following detailed description are exemplary and explanatory only and are not to be viewed as being restrictive of the invention, as claimed. Further advantages of this invention will be apparent after a review of the following detailed description of the disclosed embodiments, which are illustrated schematically in the accompanying drawings and in the appended claims.

DETAILED DESCRIPTION OF EMBODIMENTS OF THE INVENTION

Embodiments of the invention generally relate to a tool for loosening and/or unscrewing a screw 2 (FIG. 1) removably embedded (screwed) in an object 4. Embodiments of the invention have a frame 6 dimensioned and configured to receive (or be mounted on) an object 4 having at least one screw 2 removably embedded therein. Some embodiments of the invention can be used to loosen and/or remove a screw from a High Speed Anti-Radiation Missile (HARM). In some embodiments, the frame 6 is C-shaped, allowing the invention to mount on an object 4 without passing the object 4 longitudinally through the frame 6. Where the frame 6 is C-shaped, the frame 6 includes an upper extension 8) and a lower extension 10. Where the frame 6 is C-shaped and includes an upper extension 8 and a lower extension 10, the inner surfaces of the upper extension (8 and the lower extension 10 are separated by an amount greater than the diameter of the object 4.

The frame 6 has at least one adjustable stability providing device 12 associated therewith. In some embodiments, the adjustable stability providing device 12 is formed of parts including a lower drive screw 14 and contact plate 16. In embodiments where the adjustable stability providing device 12 is formed of a lower drive screw 14 and contact plate 16, the lower drive screw 14 passes through an aperture (18 in FIG. 2) in the lower extension 10 of the C-shaped frame 6 and associates with a lower contact plate 16 located on the inside of (but not necessarily touching the inside of) the frame 6 such that rotating the lower drive screw 14 causes the lower contact plate 16 to move radially with respect to the lower extension 10. In practice, when mounted on the object 4 and properly adjusted, the stability providing device 12 provides force against the object 4 in a direction that allows the screw removal device 20 to maintain pressure against the screw 2 while the screw 2 is being unscrewed (as shown in FIG. 1).

Figure 2:
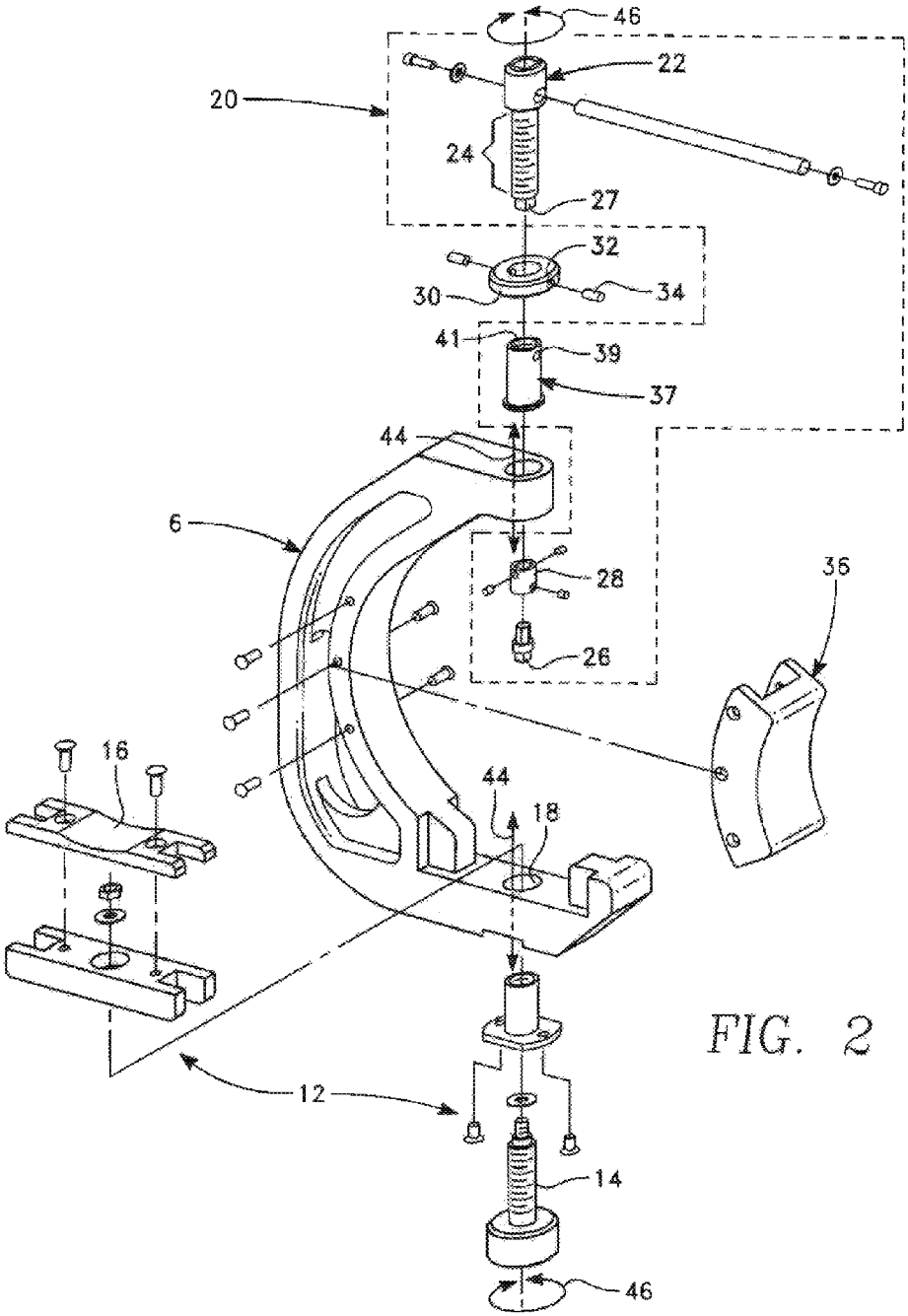
FIG. 2 is a perspective view of an un-assembled embodiment of a screw removal tool in accordance with the principles of the invention.
Figure 3:
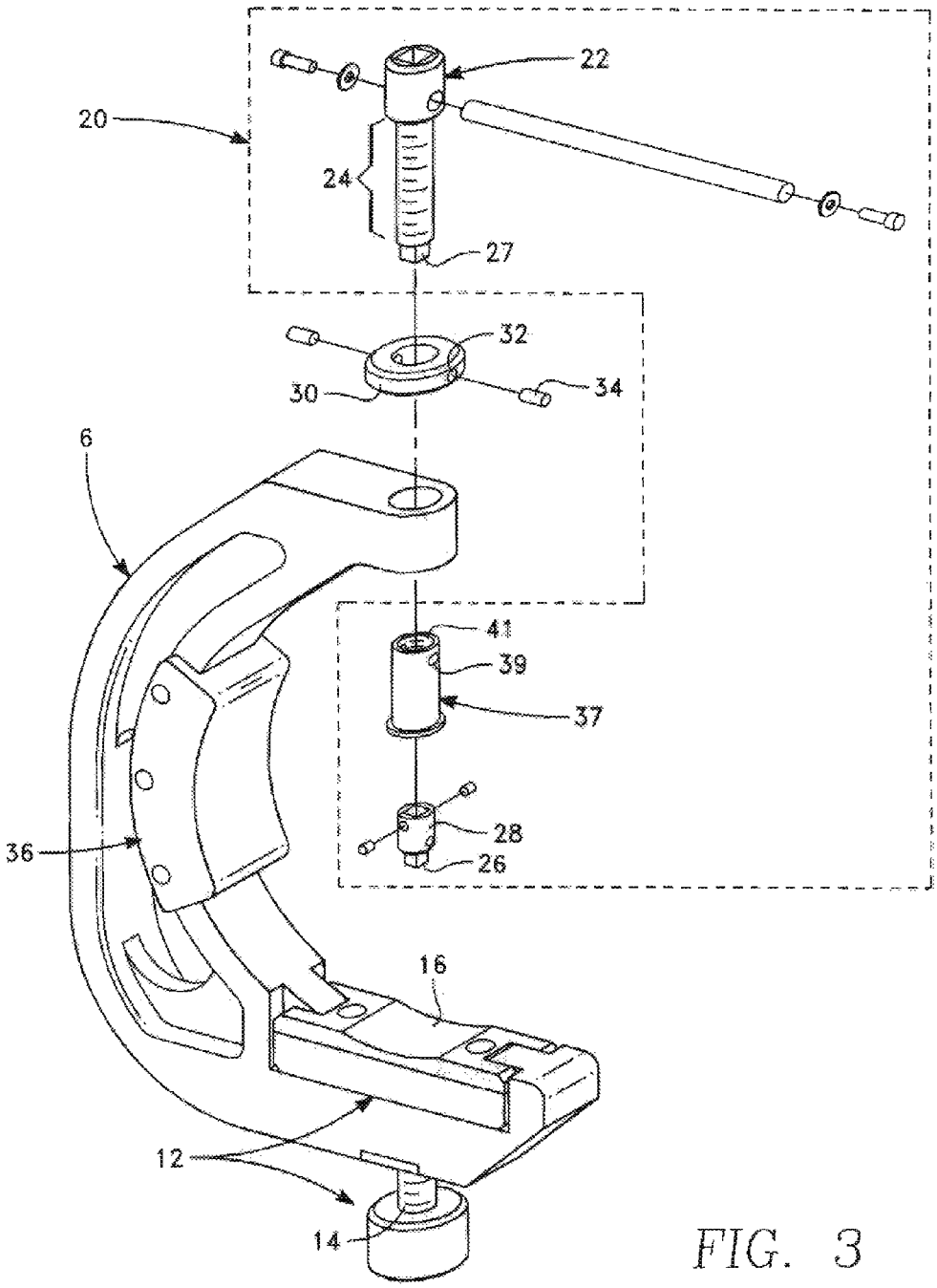
FIG. 3 is a perspective view of a partially un-assembled embodiment of a screw removal tool in accordance with the principles of the invention.

In FIGS. 1-3, the frame 6 has at least one screw removal device 20 associated therewith. The screw removal device 20 passes through the frame 6 at a point on the frame 6 opposite the adjustable stability providing device 12. The screw removal device 20 is adapted to rotate co-axially and move radially (44 in FIG. 2) (or transversely with respect to the upper extension 8 in FIG. 1) when the upper drive screw 22 is co-axially rotated (46 in FIG. 2). The screw removal device 20 has a threaded portion (24 in FIGS. 2-3) and a portion matable with at least one recess on the head of at least one screw 26. The thread pitch of the threaded portion (24 in FIGS. 2-3) of the upper drive screw 22 matches the thread pitch of the screw to be removed (2 in FIG. 1). In some embodiments, the screw removal device 20 is formed of an upper drive screw 22, a socket 28, a bit 26, and a sleeve (37 in FIGS. 2-3). In embodiments where the screw removal device includes a sleeve (37 in FIGS. 2-3), the sleeve (37 in FIGS. 2-3) has a threaded inner recess (41 in FIGS. 2-3) that is configured to threadingly associate with the threaded portion (24 in FIGS. 2-3) of the upper drive screw 22.

In embodiments where the screw removal device 20 is formed of an upper drive screw 22, a socket 28, and a bit 26, the upper drive screw 22 has a threaded portion (24 in FIGS. 2-3) and a connector portion (27 in FIGS. 2-3) adapted to removably mate with a socket 28 that removably associates with a bit 26. The part of the screw removal device 20 that is matable with at least one recess on the head of the screw to be removed (2 in FIG. 1) (in some embodiments a bit 26) has at least one hatch matable with at least one recess on the head of the screw (2 in FIG. 1).

Embodiments of the invention include a knob 30 to adjust the radial (44 in FIG. 2) (or transverse with respect to the frame) orientation of the screw removal device 20 without rotating the screw removal device 20. In embodiments having an upper drive screw 22, the upper drive screw 22 passes through the knob 30 and sleeve (37 in FIGS. 2-3). In some embodiments (shown in FIGS. 2-3), the knob 30 has at least one aperture 32 into (or through) which a setscrew 34 screws (or passes). When screwed in a sufficient amount, the set screw 34 is designed to associate with the sleeve 37 at grooves or apertures 39 in the sleeve 37 such that rotating the knob 30 causes the sleeve 37 to rotate, thereby causing the screw removal device 20 to move radially (44 in FIG. 2) (or transversely with respect to the frame 6) without rotating the upper drive screw 22.

Some embodiments of the invention (as shown in FIG. 1) include a seat guide 36 removably associated with the frame 6. The seat guide 36 is adapted and configured to associate with the housing of the object 4 when the screw removal tool is mounted on the object 4.

The screw removal tool can be reconfigured to mount on objects 4 of different sizes by modifying the adjustable stability providing device 12 and the bit 26. In embodiments where a seat guide 36, lower contact plate 16, bit 26 and lower drive screw 14 are included, the screw removal tool can be reconfigured to mount on objects of different sizes by: 1) replacing the bit 26 with a different dimensioned bit 26; 2) replacing the seat guide 36 with a different dimensioned seat guide 36; and 3) replacing the upper drive screw 22 with a different dimensioned (including thread pitch) upper drive screw 22.

A method performed in accordance with principles of the invention involves mounting a screw removal tool described onto an object 4 such that the seat guide 36 associates with the object 4.

The stability providing device 12 is adjusted to associate with a surface of the object 4. In some embodiments, this involves rotating the lower drive screw 14 until the contact plate 16 associates with the object 4.

The screw removal device 20 is aligned with any recesses of the screw 2 head. The radial (44 in FIG. 2) (or transverse with respect to the frame) orientation of the screw removal device 20 is adjusted by rotating the knob 30 until the portion matable with the screw 26 mates with the screw head 2; in order to mate with the screw 2, the screw removal device 20 may need to be co-axially rotated (46 in FIG. 2).

The screw removal device 20 is then rotated to loosen the screw 2. Pressure is maintained on the screw 2 while unscrewing the screw 2 due to the association of the screw removal tool with the object 4 housing at three points: the seat guide (36 in FIGS. 1-3), the adjustable stability providing device 12, and the screw removal device 20.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

What is claimed is:

1. A screw removal tool for removing a screw from a missile, comprising:

a c-shaped frame having a lower extension and an upper extension, said c-shaped frame configured and dimensioned to receive a missile having a screw removably embedded therein;

an adjustable contact plate on an inner surface of said lower extension of said c-shaped frame;

a lower drive screw that passes through an aperture in said lower extension of said c-shaped frame, said lower drive screw being associated with said adjustable contact plate such that rotating said lower drive screw causes said adjustable contact plate to move radially with respect to said lower extension and contact said object when said screw removal tool is mounted on said missile;

a seat guide to contact an outer surface of said missile about 90 degrees from center of said missile from where said adjustable contact plate contacts said missile and from the location of said at least one screw removably embedded in said missile when said screw removal tool is mounted on said missile, said seat guide sitting on the inner surface of said c-shaped frame between said lower extension and said upper extension;

a bit having at least one hatch matable with at least one recess on a head of said at least one screw removably embedded in said missile;

a socket removably mated with said bit;

a sleeve that passes through an upper extension aperture in said upper extension, said sleeve having a threaded inner recess, said sleeve having a groove, said sleeve passing through said aperture in said upper extension at a location directly opposite said adjustable contact plate;

an upper drive screw passing through said sleeve; said upper drive screw having a connector portion and a threaded portion, wherein said connector portion is adapted to mate with said socket and said threaded portion is configured to threadingly associate with said threaded inner recess of said sleeve, said threaded portion having a thread pitch that matches the thread pitch of said screw removably embedded in said missile; said upper drive screw having a head that includes a square shaped groove to receive a socket fitting;

a set screw; and a knob having an knob aperture and positioned to sit on an outer surface of said c-frame such that said knob aperture vertically lines up with said sleeve aperture; said sleeve passing through said knob aperture; said knob having at least one setscrew aperture through which said setscrew passes and associates with said groove such that rotating said knob causes said sleeve to rotate; said knob adapted to adjust radial orientation of said bit without rotating said upper drive screw by rotating said sleeve;

said upper drive screw, said sleeve, and said knob cooperating to simultaneously move said upper drive screw radially with respect to said upper extension and rotate said bit co-axially when said upper drive screw is co-axially rotated and said knob is not rotated.

2. A screw removal tool for removing a screw from a missile, consisting of:

a c-shaped frame having a lower extension and an upper extension, said c-shaped frame configured and dimensioned to receive a missile having a screw removably embedded therein;

an adjustable contact plate on an inner surface of said lower extension of said c-shaped frame;

a lower drive screw that passes through an aperture in said lower extension of said c-shaped frame, said lower drive screw being associated with said adjustable contact plate such that rotating said lower drive screw causes said adjustable contact plate to move radially with respect to said lower extension and contact said object when said screw removal tool is mounted on said missile;

a seat guide to contact an outer surface of said missile about 90 degrees from center of said missile from where said adjustable contact plate contacts said missile and from the location of said at least one screw removably embedded in said missile when said screw removal tool is mounted on said missile, said seat guide sitting on the inner surface of said c-shaped frame between said lower extension and said upper extension;

a bit having at least one hatch matable with at least one recess on the head of said at least one screw removably embedded in said missile;

a socket removably mated with said bit;

a sleeve that passes through an upper extension aperture in said upper extension, said sleeve having a threaded inner recess, said sleeve having a groove, said sleeve passing through said aperture in said upper extension at a location directly opposite said adjustable contact plate;

an upper drive screw passing through said sleeve; said upper drive screw having a connector portion and a threaded portion, wherein said connector portion is adapted to mate with said socket and said threaded portion is configured to threadingly associate with said threaded inner recess of said sleeve, said threaded portion having a thread pitch that matches the thread pitch of said screw removably embedded in said missile; said upper drive screw having a head that includes a square shaped groove to receive a socket fitting;

a set screw; and a knob having an knob aperture and positioned to sit on an outer surface of said c-frame such that said knob aperture vertically lines up with said sleeve aperture; said sleeve passing through said knob aperture; said knob having at least one setscrew aperture through which said setscrew passes and associates with said groove such that rotating said knob causes said sleeve to rotate; said knob adapted to adjust the radial orientation of said bit without rotating said upper drive screw by rotating said sleeve;

said upper drive screw, said sleeve, and said knob cooperating to simultaneously move said upper drive screw radially with respect to said upper extension and rotate said bit co-axially when said upper drive screw is co-axially rotated and said knob is not rotated.

* * * * *